United States Patent [19]

Torbet et al.

[11] 3,981,469

[45] Sept. 21, 1976

[54] HANGER FOR SUSPENDED CONCRETE FORMS

[75] Inventors: Philip A. Torbet, San Mateo; Cyril Thomas Eager, San Francisco, both of Calif.

[73] Assignee: The Burke Company, San Mateo, Calif.

[22] Filed: Nov. 6, 1975

[21] Appl. No.: 629,121

[52] U.S. Cl. ..... 248/235; 249/23

[51] Int. Cl.[2] ..... E04B 1/00; E04G 17/16

[58] Field of Search ..... 248/235, 214, 72, 228; 249/23, 24, 25, 219 R, 211, 207; 52/326

[56] References Cited

UNITED STATES PATENTS

| | | | |
|---|---|---|---|
| 471,348 | 3/1892 | Collis | 248/72 X |
| 1,384,437 | 7/1921 | Edelmann | 248/72 |
| 2,877,974 | 3/1959 | Estes | 248/228 |
| 2,985,936 | 5/1961 | Hillberg | 249/211 X |
| 3,119,590 | 1/1964 | Eriksson | 249/219 R X |
| 3,626,648 | 12/1971 | Beckham | 249/207 |
| 3,782,675 | 1/1974 | Boil | 249/211 X |
| 3,782,676 | 1/1974 | Boll | 249/23 |
| 3,806,074 | 4/1974 | Ward | 249/23 X |

*Primary Examiner*—J. Franklin Foss

*Attorney, Agent, or Firm*—Naylor, Neal & Uilkema

[57] ABSTRACT

A hanger for suspending concrete forms from a beam or other support. The hanger is provided with cast ends which have screw threaded openings proximate their upper portions for receipt of a tension rod and non-threaded sockets proximate their lower portions for receipt of a compression strut. The ends are also provided with openings for the receipt of support rods used to suspend forms from the hanger and these openings accommodate the suspension of such support rods at varying angles relative to the ends.

6 Claims, 5 Drawing Figures

HANGER FOR SUSPENDED CONCRETE FORMS

BACKGROUND OF THE INVENTION

The present invention relates to a hanger for supporting concrete forms from structural elements, such as I-beams. The invention is particularly concerned with such a hanger which is adapted to accommodate suspension elements disposed at varying angles and which is adapted to be readily modified on a job site to accommodate various types and sizes of supporting elements used in combination therewith.

The prior art relating to hangers for suspending concrete forms is very well developed, as exemplified by U.S. Pat. Nos. 2,985,936; 3,119,590; 3,782,675; and, 3,782,676. These patents disclose hangers adapted to suspend forms to either side of a support element and are typified by the inclusion of a rod which spans the support element and ends welded to opposite extremities of the rod. The rods carry tension loads and the ends are provided with means to engage the support element so as to impart compressive loads thereto. Where it is desired to accommodate suspension elements disposed at different angles relative to the hanger, modified hanger ends are provided.

SUMMARY OF THE INVENTION

A key element of the present invention is the unique end which forms part of the hanger. The end comprises a body having an undersurface adapted to rest upon an element upon which the hanger is supported; a non-threaded socket opening through a lower portion of one side of the body; a screw threaded opening opening through an upper portion of said one side; and, at least one suspension rod receiving opening extending through the body and opening through a side thereof opposite the one side. In the assembled condition of the hanger, a pair of such ends are disposed in spaced relationship to one another with a tension rod secured between the threaded openings and a compression strut dispersed between the non-threaded sockets.

A principal object of the invention is to provide a hanger which may be modified at the work site to accommodate support elements of different sizes and shapes.

Another and related object of the invention is to provide a hanger wherein such modifications may be achieved without altering the ends of the hanger.

Still another object of the invention is to provide a hanger which will accommodate suspension elements disposed at at least two different angles relative to the hanger.

A further object of the invention is to provide a hanger which incorporates complementary tension and compression elements.

Still another object of the invention related to the latter object is to provide a hanger wherein endwise compressive forces applied to the hanger are resisted by a compression element forming part of the hanger.

A further object of the invention is to provide a hanger which is not dependent upon endwise engagement with a support element to resist endwise compressive loads imparted to the hanger.

Yet another object of the invention is to provide a hanger with cast ends which are secured to one another by a tension rod in screw-threaded engagement therewith, which rod is not dependent upon welding to secure it in place.

Still another object of the invention is to provide a hanger which incorporates a compression strut which may be inserted into place from the underside of the hanger after the ends of the hanger are secured to one another through means of a screw-threaded tension rod extending therebetween.

The foregoing and other objects will become more apparent when viewed in light of the accompanying drawing and following detailed description.

DESCRIPTION OF THE ILLUSTRATED EMBODIMENT

Figure 1:
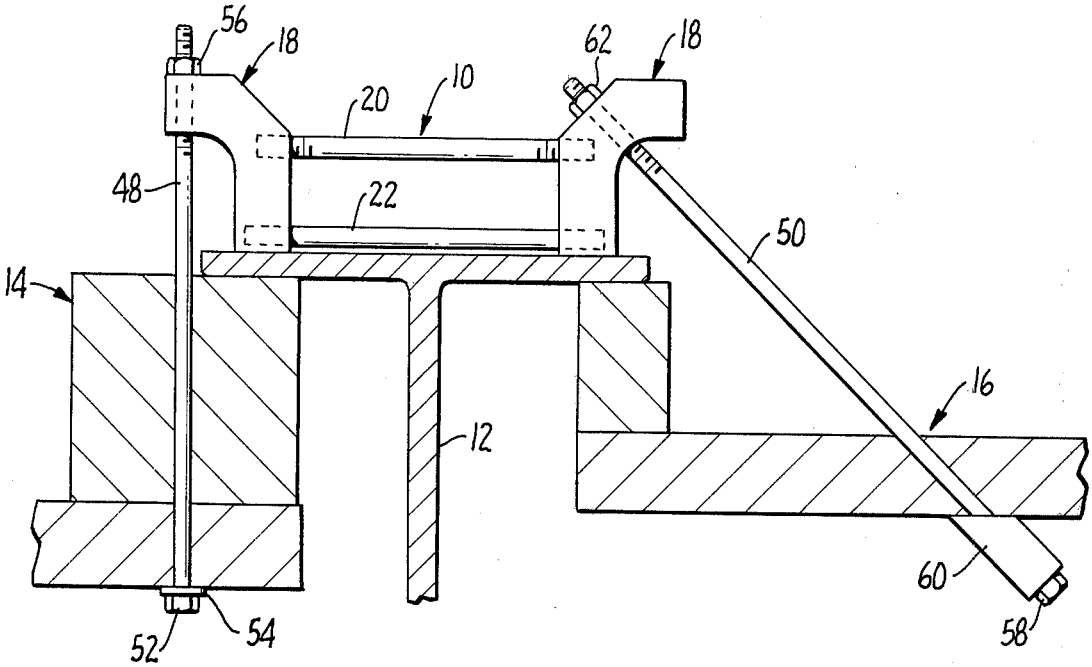
FIG. 1 is an elevational view, with parts thereof broken away and shown in section, illustrating the hanger of the present invention supported on an I-beam and suspending concrete forms to either side of the beam.
Figure 3:
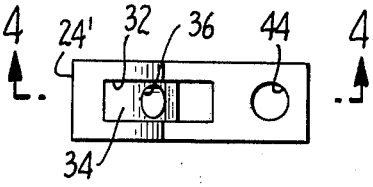
FIG. 3 is a top plan view of the end illustrated in FIG. 2.
Figure 2:
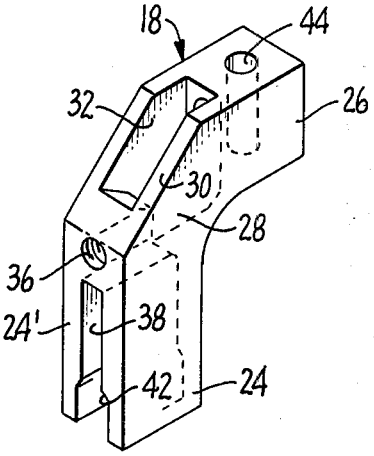
FIG. 2 is a perspective view of one end of the hanger.

Referring now to FIG. 1, the hanger is designated in its entirety by the numeral 10 and is shown supported on an I-beam 12 from which it is desired to suspend concrete forms. Suspended forms are shown in FIG. 1 and designated by the numerals 14 and 16. The form 14 is typical of the type of form which would be suspended between two I-beam supports and the form 16 is more typical of the type of form which might be cantilevered from an I-beam.

The hanger 10 comprises a pair of identical ends 18 interconnected by a tension rod 20 and a compression strut 22. In the preferred embodiment illustrated, the ends are fabricated of cast metal, such as cast iron or steel. The exact material chosen for the casting will depend upon the strength requirements.

Figure 5:
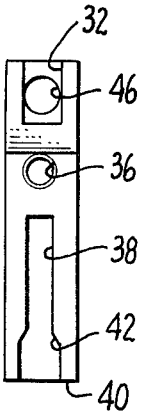
FIG. 5 is an elevational view of the end illustrated in FIG. 2, as it would appear when viewed from the left side of FIG. 2.
Figure 4:
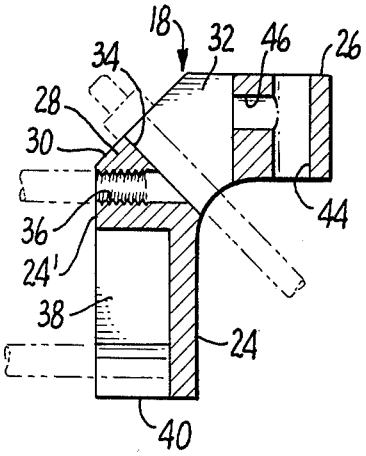
FIG. 4 is a cross-sectional elevational view taken on the plane designated by Line 4—4 in FIG. 3, with phantom line illustrations showing the various rod and strut elements which cooperate with the end.

Each end is of generally L-shaped configuration and comprises a downwardly dependent leg 24 and the laterally extending leg 26. The legs 24 and 26 extend in generally normal relationship to one another and are joined by an intermediate portion 28 having an outer surface 30 extending at approximately a 45° angle relative to the legs. A slot 32 extends through the intermediate portion 28 and has a lower surface 34 disposed in normal relationship to the surface 30. The inner side of the leg 24 is designated by the numeral 24' and has a screw-threaded opening 36 in the upper portion thereof and a slot-shaped socket 38 in the lower portion thereof. The socket 38 opens through the side 24' and the undersurface of the end, designated 40. As may best be seen from FIG. 5, the lower portion of the slot 38 is enlarged, relative to the upper portion. The upper and lower portions of the slot merge through angled shoulders 42.

The upper leg 26 has a passage 44 extending therethrough in generally parallel relationship to the leg 24. The passage 44 is intersected by an opening 46 extending generally normal thereto and opening into the slot 32. In situations where the slot 32 is not used, the opening 46 may be screw-threaded similarly to the opening 36 to receive a tension rod.

In use, the hanger 10 is normally supplied in a disassembled condition with the ends 18, rod 20 and strut 22 separate from one another. Once the size of I-beam 12 or other support with which the hanger is to be used is determined, a rod and strut of the proper length are chosen and the hanger is assembled. Assembly simply comprises screwing the ends 18 onto the rod 20 and then inserting the strut 22 into place within the slot 38. The open lower end of the slot permits the strut to be inserted into place, even after the ends are screwed into place on the rod 20. The strut 22 is ideally of such diameter that it will bear against the shoulders 42 and is chosen of a length so that it will bear against the inner surfaces of the slots 38.

After the hanger is assembled, it may be used in the manner exemplified in FIG. 1. In this use, the hanger is supported on the I-beam 12 with the under surfaces 40 of the ends in engagement with the upper surface of the I-beam. With the hanger so positioned, a suspension rod 48 is extended through the passage 44 of the lefthand end 18 to support the form 14 and a suspension rod 50 is extended through the slot 32 of the righthand end 18 to support the form 16. The rod 48 supports the form 14 through means of a head 52 and a washer 54 at the lower end of the rod and a nut 56 threadably received on the upper end of the rod for engagement with the upper surface of the lefthand end 18. The rod 50 supports the form 16 through means of a head 58 and spacer 60 at the lower end of the rod and a nut 62 threadably received on the upper end of the rod in abutting engagement with the surface 30 of the righthand end 18.

With the hanger and forms assembled as illustrated in FIG. 1, the suspension rod 48 functions to impart a counterclockwise moment to the lefthand end 18 and the suspension rod 50 functions to impart a clockwise moment to the righthand end 18. These moments, in turn, function to place the rod 20 under tension and the strut 22 under compression. The hanger is not dependent upon engagement with the I-beam to resist the compressive forces resulting from the moments applied to the hanger.

Although FIG. 1 shows one end of the hanger with a suspension rod (48) extending through the opening 40 and the other end of the hanger with a suspension rod (50) extending through the opening 32, it should be understood that the suspension rods at both ends of the hanger could extend through corresponding openings in the ends. The choice of which opening is used is at the discretion of the user and will depend upon the environment in which the hanger is used. It should also be understood that where the openings 32 are not used for the receipt of rods as exemplified by the rod 50, the openings 46 might be screwthreaded for receipt of a tension rod similar to the rod 20. Such a tension rod might be used in addition to or as an alternative to the rod 20 received within the openings 36.

The invention is not intended to be limited to the specifics of the embodiment herein illustrated and described, but rather is defined by the accompanying claims.

What is claimed is:

1. A hanger for suspending concrete forms, said hanger comprising: a pair of ends disposed in spaced relationship to one another, said respective ends having opposed screw threaded openings in the upper portions thereof and opposed non-threaded sockets in the lower portions thereof, and each said end also having a suspension rod opening for the receipt and support of a suspension rod and an undersurface adapted to rest upon a member upon which the hanger is supported; a tension rod extending between said ends, said rod having screw threaded portions threadably engaged with the opposed threaded openings in said ends; and, a compression strut extending between said ends beneath said tension rod, said strut having ends received within said non-threaded sockets in abutting compression imparting relationship to the ends.

2. An end for a hanger for suspending concrete forms, said end comprising: a body having an undersurface adapted to rest upon a member upon which the hanger is supported; a non-threaded socket opening through a lower portion of one side of the body; a screw threaded opening opening through an upper portion of said one side of the body; and, at least one suspension rod receiving opening extending through the body and opening through a side thereof opposite said one side.

3. An end, according to claim 2, wherein the non-threaded socket comprises a slot formed in the body and opening through both said one side and said undersurface.

4. An end, according to claim 2, wherein a pair of suspension rod receiving openings extend through said body and open through the side thereof opposite said one side, said openings being disposed at an angle relative to one another whereby the angle that a suspension rod assumes relative to the end may be selectively varied by selecting the opening within which the rod is received.

5. A hanger for suspending concrete forms, said hanger comprising: a pair of ends disposed in spaced relationship to one another, said respective ends having opposed screw threaded openings in the upper portions thereof and opposed non-threaded sockets in the lower portions thereof, and each said end also having at least one pair of openings extending therethrough for receipt and support of a suspension rod, said openings being disposed at an angle relative to one another whereby the angle that a suspension rod assumes relative to an end within which the rod is received may be selectively varied by selecting the opening within which the rod is received; a tension rod extending between said ends, said rod having screw threaded portions threadably engaged with the opposed threaded openings in said ends; and, a compression strut extending between said ends beneath said tension rod, said strut having ends received within said non-threaded sockets in abutting compression imparting relationship to the ends.

6. A hanger for suspending concrete forms, said hanger comprising: a pair of ends disposed in spaced relationship to one another, said respective ends having undersurfaces adapted to rest upon a member upon which the hanger is supported, opposed screw threaded openings in the upper portions thereof and opposed non-threaded sockets in the lower portions thereof, said non-threaded sockets opening through said undersurfaces; a tension rod extending between said ends, said rod having screw threaded portions threadably engaged with the opposed threaded openings in said ends; and, a compression strut extending between said ends beneath said tension rod, said strut having ends received within said non-threaded sockets in abutting compression imparting relationship to the ends and being insertable into place through the undersurfaces of said ends.

* * * * *